United States Patent [19]

Kelly et al.

[11] 4,125,438

[45] Nov. 14, 1978

[54] GUIDING MEANS FOR COKE OVEN DOORS

[75] Inventors: Calvin E. Kelly; Thomas E. Nicely, both of Franklin Township, Westmoreland County, Pa.

[73] Assignee: United States Steel Corporation, Pittsburgh, Pa.

[21] Appl. No.: 834,748

[22] Filed: Sep. 19, 1977

[51] Int. Cl.[2] ..... C10B 25/06; C10B 25/16

[52] U.S. Cl. ..... 202/248; 110/173 R; 202/242

[58] Field of Search ..... 202/242, 248; 110/173 R; 49/485

[56] References Cited

U.S. PATENT DOCUMENTS 2,209,590 7/1940 Wilputte ..... 202/248

4,032,409 6/1977 Knappstein et al. ..... 202/248

FOREIGN PATENT DOCUMENTS 401,698 1974 U.S.S.R. ..... 202/248

*Primary Examiner*—Morris O. Wolk
*Assistant Examiner*—Roger F. Phillips
*Attorney, Agent, or Firm*—Walter P. Wood

[57] ABSTRACT

A means for guiding a coke oven door as it is replaced on an oven. The guide means includes bars carried by the door frame for guiding the door accurately to a position in which the sealing members contact a flat surface on the jamb to effect a seal. The forward tips of the guide bars are closely adjacent the forward edges of the sealing members so that the guide bars serve also as stops to prevent overloading of the sealing members.

8 Claims, 4 Drawing Figures

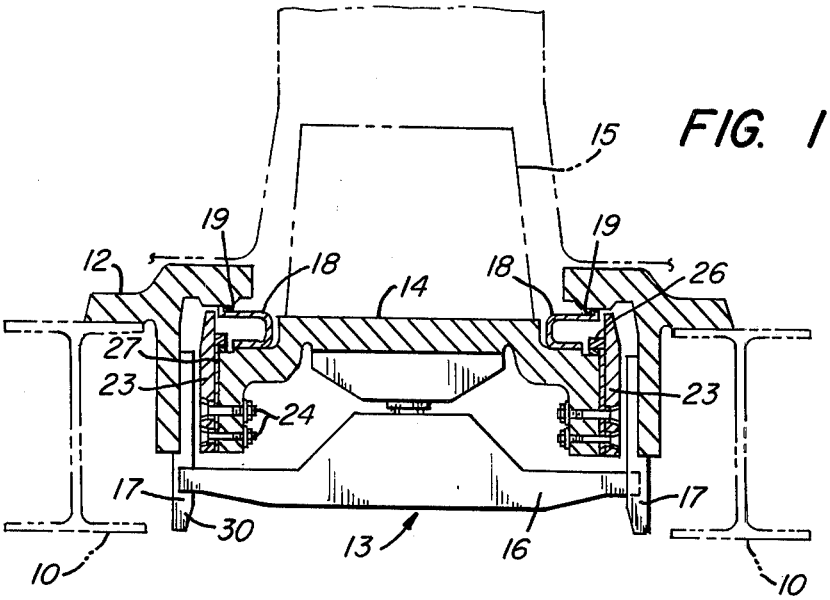
FIG. 1
FIG. 2
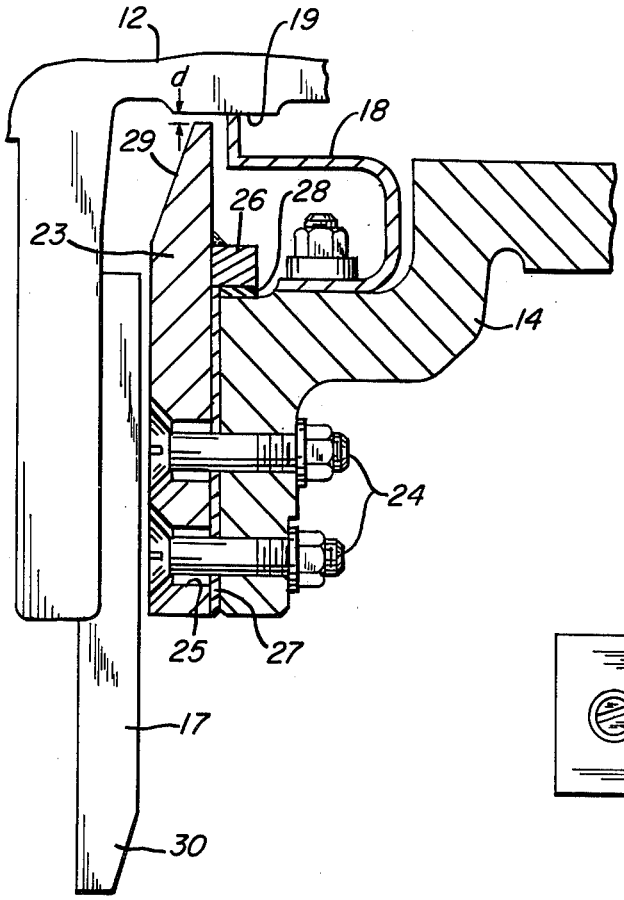
FIG. 3
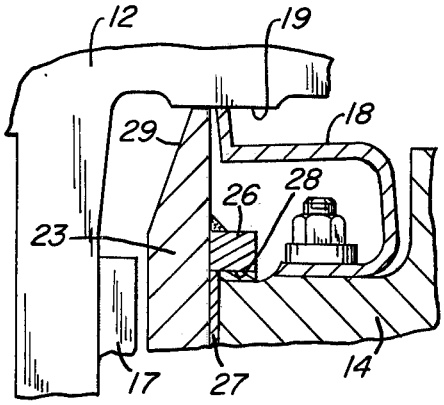
FIG. 4
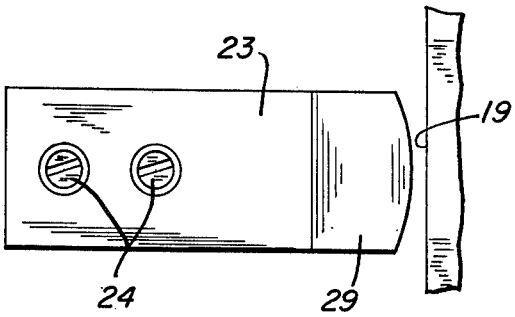

GUIDING MEANS FOR COKE OVEN DOORS

This invention relates to an improved means for guiding a coke oven door into the proper position as it is replaced on the oven and providing optimum loading of the sealing members.

One commonly used form of coke oven door has flexible metal sealing members which extend around its perimeter and contact flat surfaces on the door jamb to effect a seal against escape of gases from the oven. When the door is replaced after a charge of coke has been pushed from the oven, the door should be positioned accurately, both to assure an effective seal and to prevent damage to the sealing members. Such damage can result from the sealing members accidentally striking various parts of the oven or from overloading them. As a means for positioning a door accurately, it is known to equip the door with tapered guide bars which engage tapered surfaces on the latch hooks to guide the door as it is replaced. Reference can be made to Tucker U.S. Pat. No. 3,812,292 (FIG. 3) for a showing. The known tapered guide bars have been located a substantial distance back from the forward edge of the sealing members where they do not afford full protection to the members, particularly against overloading.

An object of the present invention is to provide, in a coke oven door, an improved arrangement of tapered guide bars which is more effective for preventing damage to the sealing members than arrangements known heretofore.

A more specific object is to provide a door equipped with tapered guide bars, the forward tips of which are located closely adjacent the forward edges of the sealing members, whereby the guide bars serve also as stops to prevent overloading the sealing members.

In the drawing:

FIG. 1 is a horizontal section of a portion of a coke oven and door equipped with tapered guide bars in accordance with our invention;

FIG. 2 is a horizontal section on a larger scale showing one of the sealing members and one tapered guide bar in the unlatched position of the door;

FIG. 3 is a fragmentary view similar to FIG. 2, but showing the parts in the latched position of the door; and FIG. 4 is a side elevational view of one of the tapered guide bars.

FIG. 1 shows a portion of a conventional coke oven which includes buckstays 10, a door jamb 12 and a removable door 13. The door has a metal frame 14 and a refractory plug 15. The door has the usual rotatable latch bars 16 which engage cooperating latch hooks 17 fixed to the jamb 12 for latching the door in its closed position. The door frame 14 carries flexible metal sealing members 18 which extend around its perimeter. The forward edges of the sealing members contact a flat surface 19 on the jamb 12 to effect a seal. Sealing members of various configurations can be used, as known in the art.

In accordance with our invention, the door frame 14 carries a plurality of guide bars 23. A different one of the guide bars is located in line with each end of each latch bar 16 when the latch bars are in latched position. The usual door has two latch bars, and hence has four guide bars in all. As best shown in FIG. 2, each guide bar 23 is affixed to the door frame with bolts 24 which extend through oversize openings 25 in the bar. A respective block 26 is welded to the inner face of each bar 23 and overlies the inside face of the door frame 14. We insert shims 27 between the guide bars 23 and the door frame, and shims 28 between the blocks 26 and the door frame. Hence the exact position of each guide bar with respect to the door frame can be adjusted within limits by inserting or removing shims. Each guide bar 23 has a tapered forward end portion 29, and each latch hook 17 a cooperating tapered rearward end portion 30. The forward tips of the guide bars are rounded as shown in FIG. 4.

In operation, when the door 13 is replaced on the oven, the tapered portions 29 on the guide bars 23 contact the tapered portions 30 on the latch hooks 17 and thus guide the door accurately to a position where the forward edges of the sealing members 18 contact the flat surface 19 on the jamb 12. The tip of each guide bar 23 is located closely adjacent the forward edge of the sealing members. The spacing between the tip and the forward edge in a direction normal to the flat surface 19 in the unlatched position of the door is indicated at "*d*" in FIG. 2. The spacing "*d*" is in the range of about 1/16 to 3/16 inch. When the door is moved into its latched position shown in FIG. 3, the tips of the guide bars contact the flat surface 19 after the sealing members make contact. Thus the guide bars serve also as stops which assure that the sealing members contact the jamb with the optimum force and prevent overloading of the sealing members. The purpose of rounding the tips of the guide bars is to assure that the distance *d* is only at a single point on the center line of the latch bar.

From the foregoing description it is seen that our invention affords a simple arrangement of guide bars for accurately positioning a coke oven door to enable flexible metal sealing members to form an effective seal. Contrasted to the known arrangement exemplified by the aforementioned Tucker patent, the guide blocks serve also as stops to prevent overloading the sealing members.

We claim:

1. In a coke oven door which includes a metal frame, latch bars rotatably mounted on said frame for latching the door in its closed position, and flexible metal sealing members extending around the perimeter of said frame and having forward edges adapted to contact a flat surface for effecting a seal, the combination therewith of improved means for guiding said door, said means comprising a plurality of guide bars affixed to said frame in line with the latch bars when the latch bars are in a position for latching the door in its closed position, said guide bars having forward end portions which taper at their outside faces toward their forward tips, the forward tips of said guide bars being closely adjacent the forward edges of said sealing members to enable said guide bars to contact said flat surface after the sealing members and serve also as stops.

2. A combination as defined in claim 1 in which said guide bars are supported for adjustment on said frame.

3. A combination as defined in claim 1 in which the spacing between the forward edges of said sealing members and the tips of said guide bars in a direction normal to the flat surface in the unlatched position of the door is in the range of about 1/16 to 3/16 inch.

4. A combination as defined in claim 1 in which the forward tips of said guide bars are rounded.

5. In a coke oven which includes a door, a jamb for receiving said door, and cooperating latch bars on said door and latch hooks on said jamb for latching the door to the jamb, said door having a metal frame and flexible metal sealing members extending around the perimeter of said frame, said jamb having a flat surface to be contacted by the forward edges of said sealing members to effect a seal, the combination therewith of:

a plurality of guide bars carried by said frame, and located in line with the ends of said latch bars when the latter are engaged with said latch hooks;

said guide bars having forward end portions which taper at their outside faces toward their forward tips and said latch hooks having rearward end portions which taper at their inside faces away from said jamb to guide the door accurately to a position in which the forward edges of said sealing members contact said flat surfaces;

the forward tips of said guide bars being closely adjacent the forward edges of said sealing members to enable said guide bars to contact said flat surfaces after said sealing members and serve also as stops.

6. A combination as defined in claim 5 in which said guide bars are supported for adjustment on said frame.

7. A combination as defined in claim 5 in which the spacing between the forward edges of said sealing members and the tips of said guide bars in a direction normal to the flat surface in the unlatched position of the door is in the range of about 1/16 to 3/16 inch.

8. A combination as defined in claim 5 in which the forward tips of said guide bars are rounded.

* * * * *